US006665907B1

(12) United States Patent
Lu

(10) Patent No.: US 6,665,907 B1
(45) Date of Patent: Dec. 23, 2003

(54) WASHER FOR A PIVOT HINGE

(76) Inventor: Sheng-Nan Lu, No. 174, Chunying St., Shulin Chen, Taipei Hsien (TW)

( * ) Notice: Subject to any disclaimer, the term of this patent is extended or adjusted under 35 U.S.C. 154(b) by 0 days.

(21) Appl. No.: 10/157,244

(22) Filed: May 30, 2002

(51) Int. Cl.[7] ..... E05C 17/64
(52) U.S. Cl. ..... 16/340; 16/337
(58) Field of Search ..... 16/340, 337, 338, 16/374, 376, 278, 341, 342; 403/111, 146, 103; 361/680–683

(56) References Cited

U.S. PATENT DOCUMENTS 2,736,027 A * 2/1956 Parmelee ..... 2/8
5,031,270 A * 7/1991 Lee ..... 16/50
5,269,047 A * 12/1993 Lu ..... 16/340
5,772,351 A * 6/1998 Ching ..... 403/111
5,913,351 A * 6/1999 Miura ..... 16/340
6,154,925 A * 12/2000 Miura ..... 16/338

FOREIGN PATENT DOCUMENTS

JP 10-26127 * 1/1998
JP 2002-139018 A * 5/2002

* cited by examiner

*Primary Examiner*—Chuck Y. Mah
(74) *Attorney, Agent, or Firm*—Rabin & Berdo, P.C.

(57) ABSTRACT

A pivot hinge has a stem, a bracket and washers provided on opposite sides of the bracket. Each washer is a disk and composed of multiple first sectorial areas and multiple sectorial areas parallel to the first sectorial areas. Each of the first sectorial areas is intermittently connected to one another and a second sectorial area is formed between two adjacent first sectorial areas.

3 Claims, 5 Drawing Sheets

WASHER FOR A PIVOT HINGE

BACKGROUND OF THE INVENTION

1. Field of the Invention

The present invention relates to a washer, and more particularly to washer for a pivot hinge with a pivot stem and a bracket. The washer is substantially a disk and composed of first sectorial areas and second sectorial areas each intermittently connected to one another. The washer is provided to opposite sides of the bracket to engage with the bracket, so that when the stem pivots, the engagement between the second sectorial areas and the bracket provides the required friction.

2. Description of Related Art

With reference to FIGS. 5 and 6, a conventional pivot hinge is composed of a bracket (60) and a stem with a threaded end (61). The bracket (60) has multiple washers (62) provided on opposite sides of the bracket (60), a lubrication disk (63) located outside the washer (62), multiple springs (64) provided outside the lubrication disk (63), a positioning disk (65) and a nut (66).

When the pivot hinge of this kind is to be assembled, the threaded end (61) of the stem extends through the washers (62) on one side of the bracket (60) and the washers (62) on the other side of the bracket (60), the lubrication disk (63), the springs (64), the positioning disk (65) and into the nut (66) to be screwingly connected to the nut (66). It is noted from the structure that when the stem pivots relative to the bracket (60), the friction required comes from the engagement between the bracket (60) and the washers (62). Because the washers (62) are completely in engagement with the bracket (60), the friction therebetween will gradually wear the washers (62), which leads to a short life span of the pivot hinge.

To overcome the shortcomings, the present invention tends to provide an improved washer for a pivot hinge to mitigate and obviate the aforementioned problems.

SUMMARY OF THE INVENTION

The primary objective of the present invention is to provide an improved washer for a pivot hinge having a stem and a bracket. The washer is a disk composed of first sectorial areas and second sectorial areas parallel to the first sectorial areas, such that with a small area engaged with the bracket, the life span of the pivot hinge is prolonged.

Other objects, advantages and novel features of the invention will become more apparent from the following detailed description when taken in conjunction with the accompanying drawings.

DETAILED DESCRIPTION OF THE PREFERRED EMBODIMENT

Figure 1:
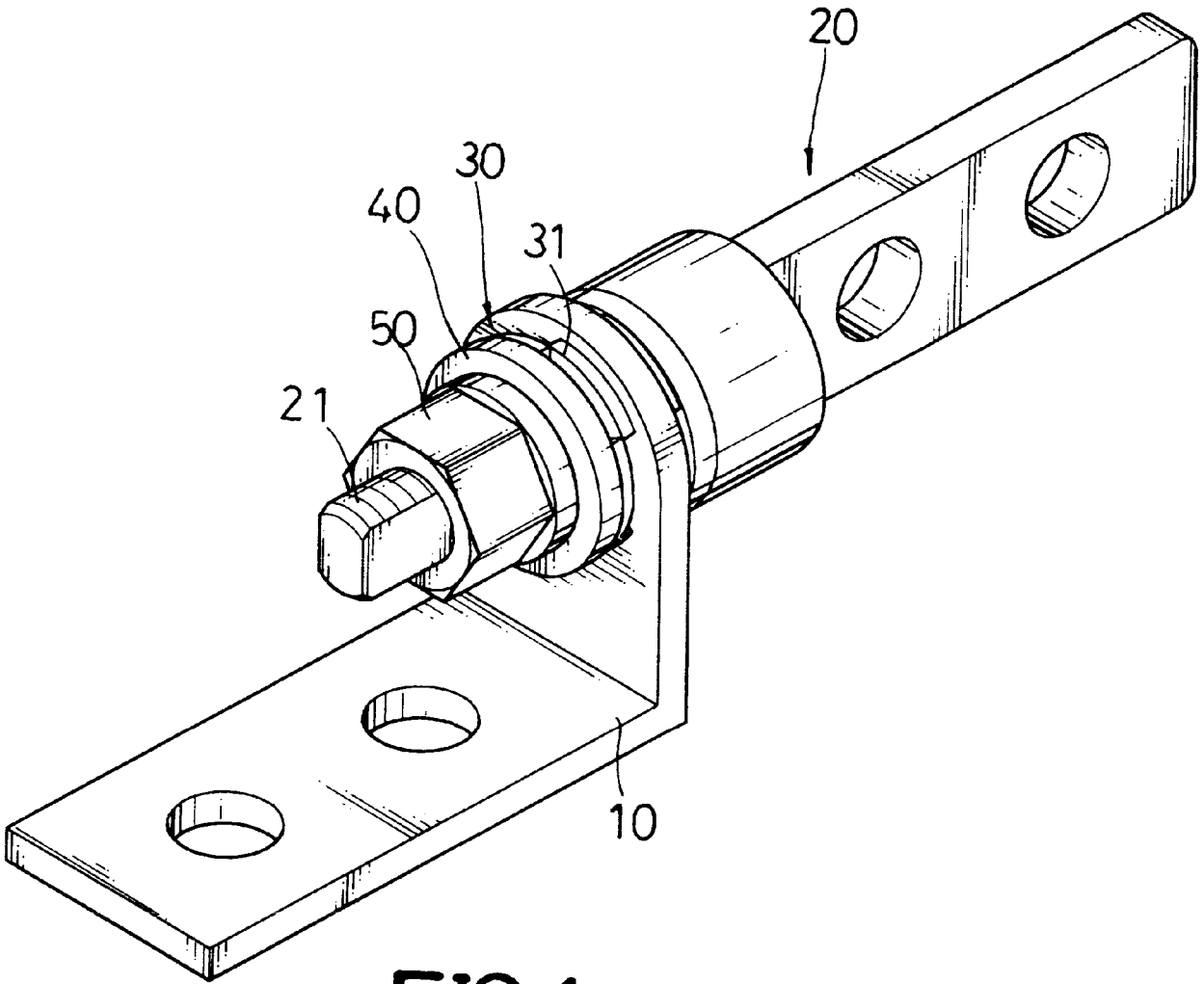
FIG. 1 is a perspective view of the pivot hinge of the present invention.
Figure 2:
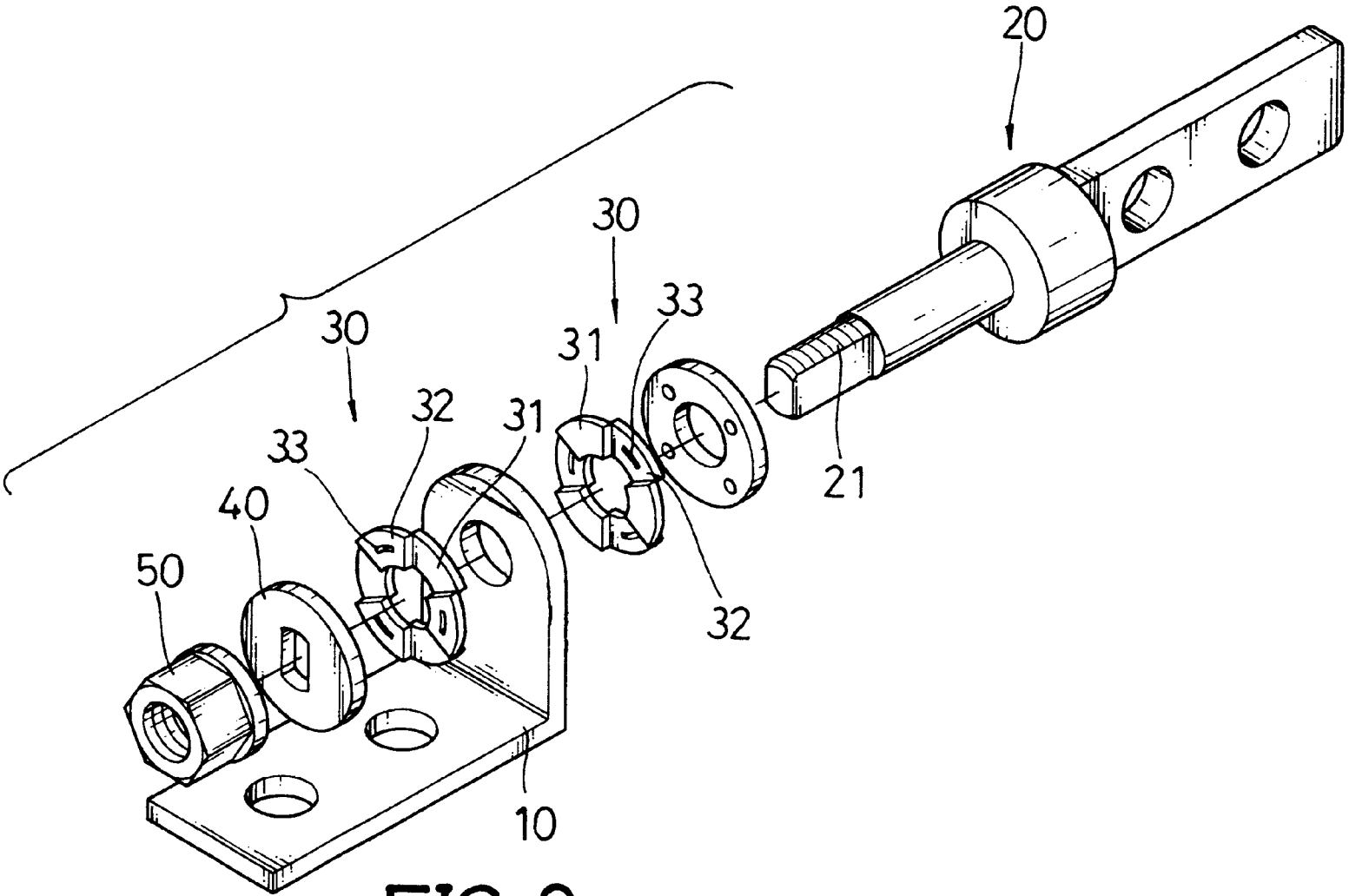
FIG. 2 is an exploded perspective view of the pivot hinge shown in FIG. 1.

With reference to FIGS. 1 and 2, the pivot hinge in accordance with the present invention is composed of a bracket (10), a stem (20), washers (30), a positioning disk (40) and a nut (50). Because the bracket (10), the stem (20), the positioning disk (40) and the nut (50) are conventional in the art, and are not the focus of the present invention, detailed description thereof is omitted hereinafter.

It is appreciated especially from FIG. 2 that the each washer (30) is substantially a disk and composed of multiple first sectorial areas (31) and multiple sectorial areas (32) parallel to the first sectorial areas (31). Each of the first sectorial areas (31) is intermittently connected to one another. That is, a second sectorial area (32) is formed between two adjacent first sectorial areas (31). Furthermore, to increase the lubrication between the washers (30) and the bracket (10), a slit (33) is defined in each of the second sectorial areas (32) so that the user is able to add in lubrication to lubricate the contact between the washers (30) and the bracket (10).

Figure 3:
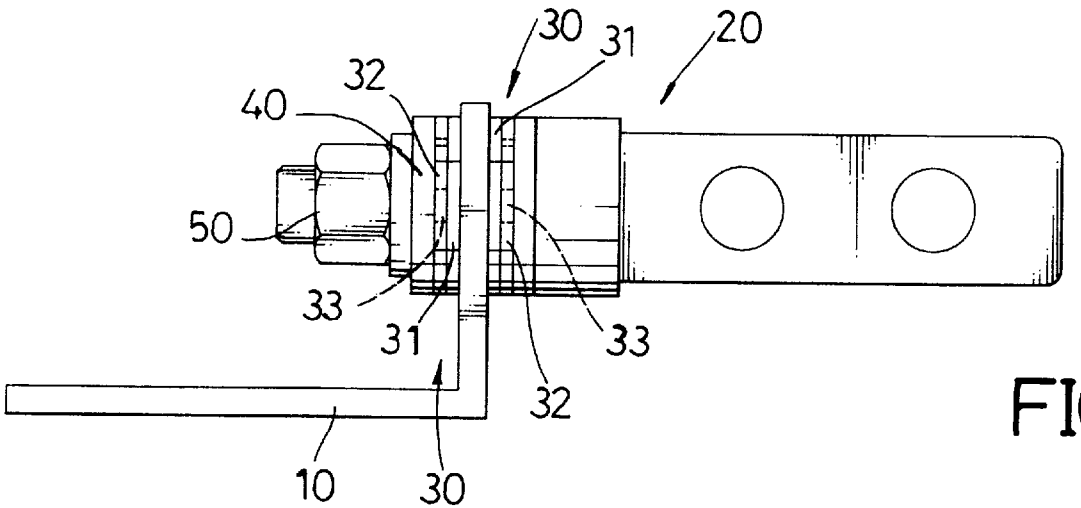
FIG. 3 is a side plan view of the pivot hinge in assembly.
Figure 4:
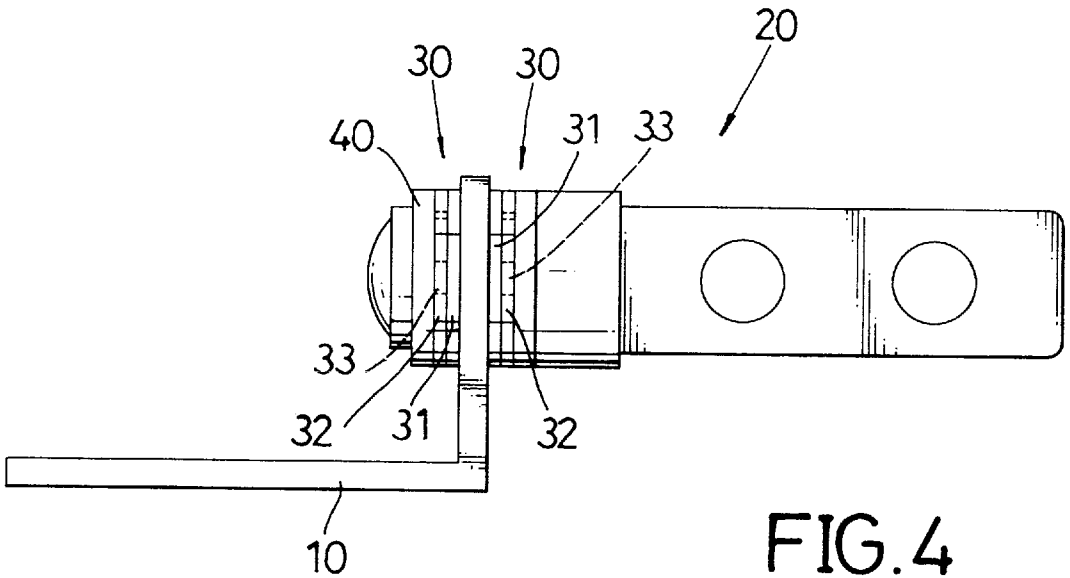
FIG. 4 is a side plan view of the pivot hinge in assembly of still another preferred embodiment of the present invention.
Figure 5:
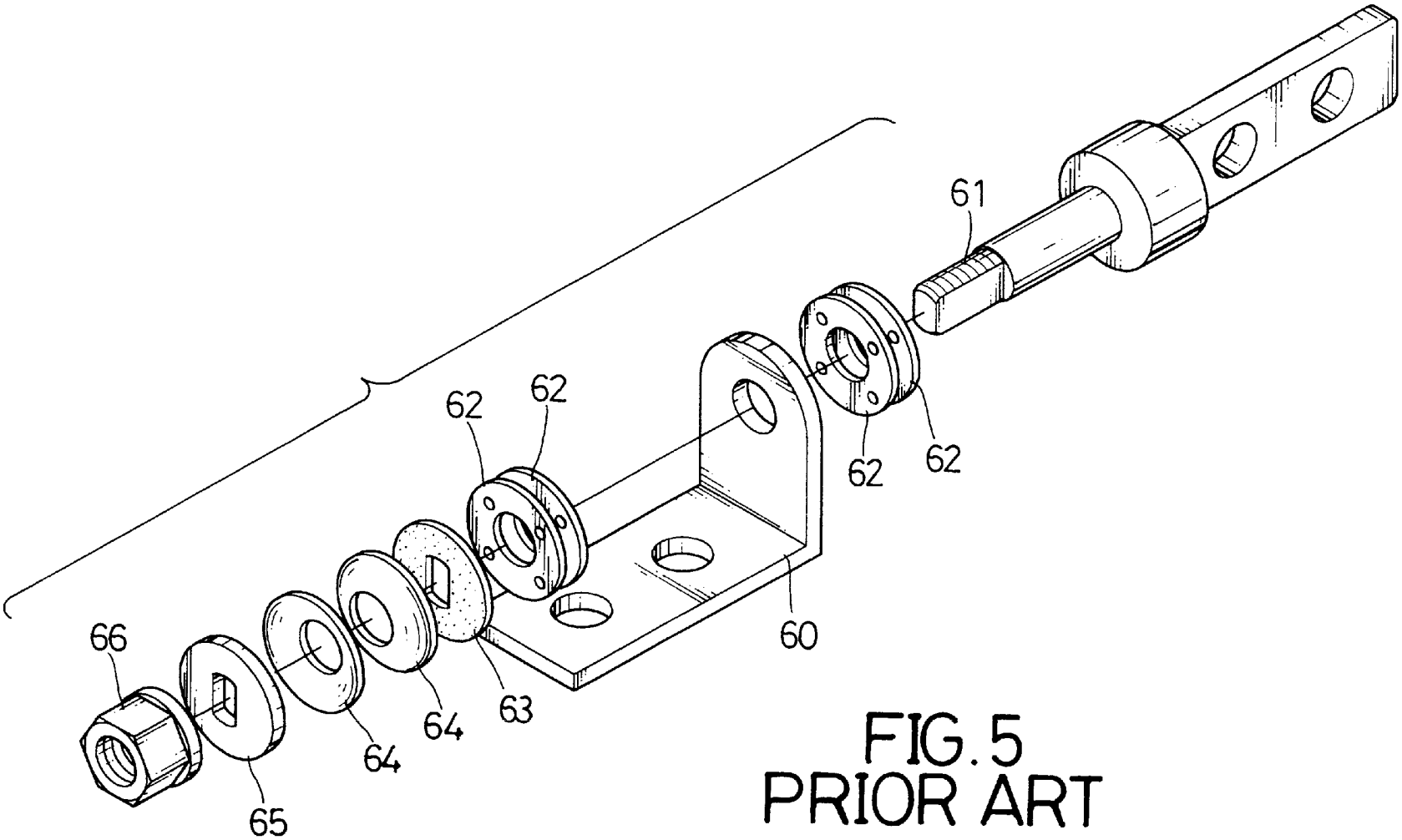
FIG. 5 PRIOR ART
FIG. 5 is an exploded perspective view of a conventional pivot hinge.
Figure 6:
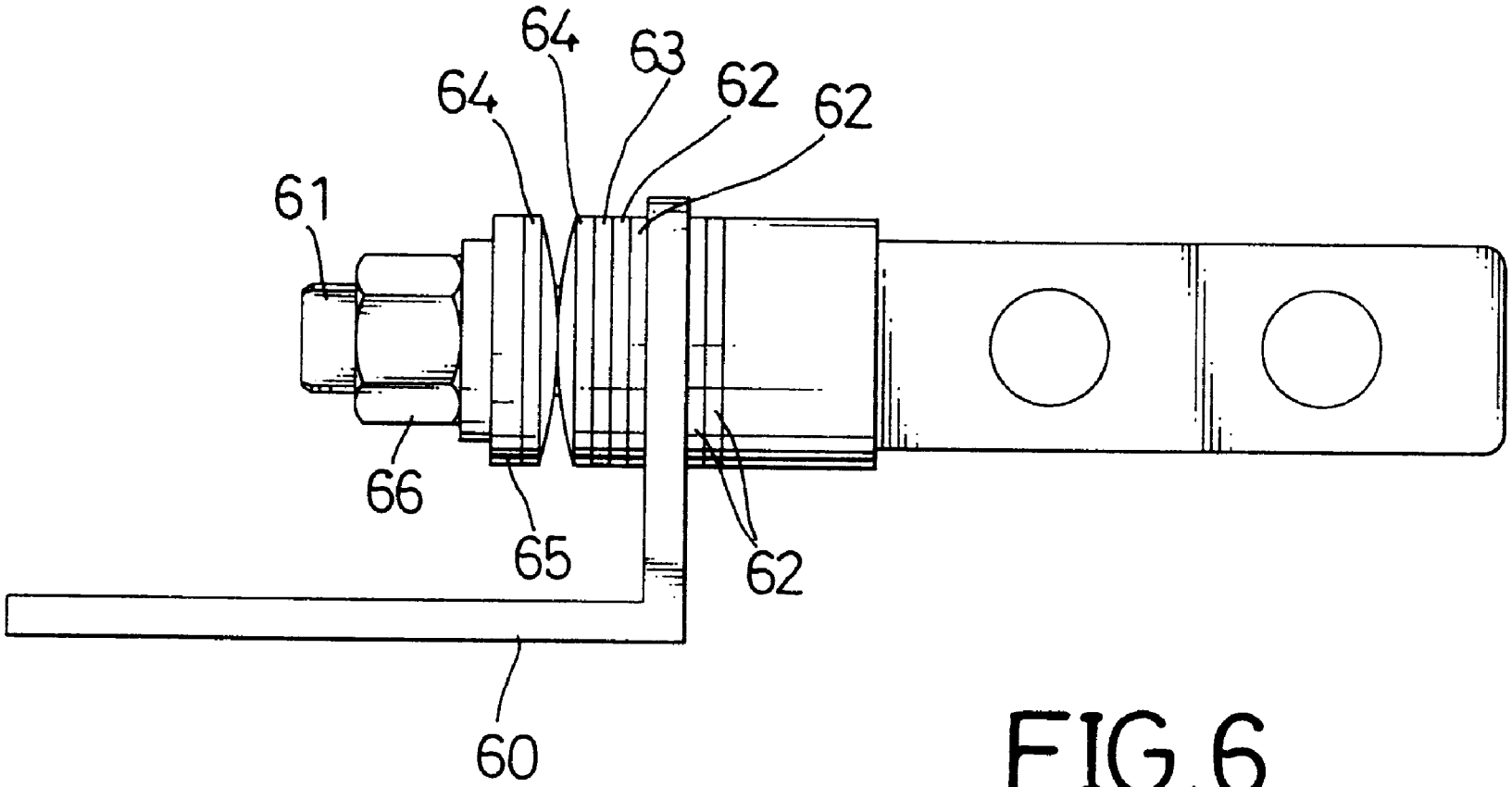
FIG.6 PRIOR ART
FIG. 6 is a perspective view of the conventional pivot hinge in FIG. 5.

With reference to FIGS. 3 and 4, after the assembly of the pivot hinge of the present invention via the nut (50) secured to a threaded end (21) of the stem (20), as shown in FIG. 3, or a rivet (not numbered) secured to the threaded end (21), as shown in FIG. 4, only the first sectorial areas (31) engage with the bracket (10). Because friction of the pivot hinge comes from the engagement between the washers (30) and the bracket (10) and there are only the first sectorial areas (31) engaging with the bracket (10), the wear as a result of friction to the washers (30) is low, such that the life span of the washers (30) is prolonged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pivot hinge, comprising:

a bracket;

a stem extending through a hole in said bracket; and a plurality of disc-shaped washers, each washer having a central hole that allows said washers to be positioned on said stem, at least one of said washers being positioned on one side of said bracket, and at least another one of said washers being positioned on an opposite side of said bracket, each washer including a plurality of first sectorial areas that project outward from one side of said washer, and a plurality of second sectorial areas that project outward from an opposite side of said washer, each of said first sectorial areas and each of said second sectorial areas being parallel to each other, and each extending from an outer periphery of said washer to the central hole, each of said first sectorial areas and said second sectorial areas being alternatingly arranged, so that each first sectorial area is bounded by two second sectorial areas, and each second sectorial area is bounded by two first sectorial areas.

2. The pivot hinge as claimed in claim 1, wherein each of said second sectorial areas has a slit formed therein.

3. The pivot hinge as claimed in claim 1, wherein each of said first sectorial areas is in direct contact with said bracket.

* * * * *